US005831396A

United States Patent [19]

Rudolph

[11] Patent Number: 5,831,396

[45] Date of Patent: Nov. 3, 1998

[54] CIRCUIT ARRANGEMENT FOR OPERATING ELECTRIC LAMP

[75] Inventor: Bernd Rudolph, Munich, Germany

[73] Assignee: Patent-Treuhand-Gesellschaft fuer Gluehlampen mbh, Munich, Germany

[21] Appl. No.: 828,983

[22] Filed: Mar. 31, 1997

[30] Foreign Application Priority Data

Apr. 3, 1996 [DE] Germany ..... 196 13 149.9

[51] Int. Cl.[6] ..... H05B 37/02

[52] U.S. Cl. ..... 315/307; 315/291; 315/209 R; 315/244; 315/DIG. 5; 315/DIG. 7

[58] Field of Search ..... 315/DIG. 5, 309, 315/291, 307, 244

[56] References Cited

U.S. PATENT DOCUMENTS 5,004,960 4/1991 Cockram et al. ..... 315/307
5,313,143 5/1994 Vila-Masot et al. ..... 315/291

FOREIGN PATENT DOCUMENTS 0 093 469 1/1987 European Pat. Off. .

OTHER PUBLICATIONS

"Schaltnetzteile: Konzepte, Bauelemente, Anwendungen", Hirschmann, 1990, pp. 62–63.

*Primary Examiner*—Don Wong
*Assistant Examiner*—Wilson Lee

[57] ABSTRACT

The invention relates to a circuit arrangement for operating electric lamps, having a free-running half-bridge inverter (Q1, Q2). An auxiliary transistor (T1, T2) is in each case connected into the control circuits of the half-bridge inverter transistors (Q1, Q2), so that the emitter impedance of each half-bridge inverter transistor (Q1, Q2) is formed by a parallel circuit which consists of at least one resistor (R5) or (R7) and the control path, arranged in parallel therewith, of the corresponding auxiliary transistor (T1) or (T2). The control inputs of the two auxiliary transistors (T1, T2) are, furthermore, connected to the output of a common control circuit (IC). These measures make it possible to switch over the effective emitter impedance and therefore the feedback of the half-bridge inverter (Q1, Q2) as a function of the operating phases of the lamp (LP) and thus, in simple fashion, to vary the clock frequency of the half-bridge inverter within wide limits by virtue of the dimensioning of the resistors (R5, R6; R7, R8) of the parallel circuits (R5, R6, T1) or (R7, R8, T2) according to the invention.

10 Claims, 1 Drawing Sheet

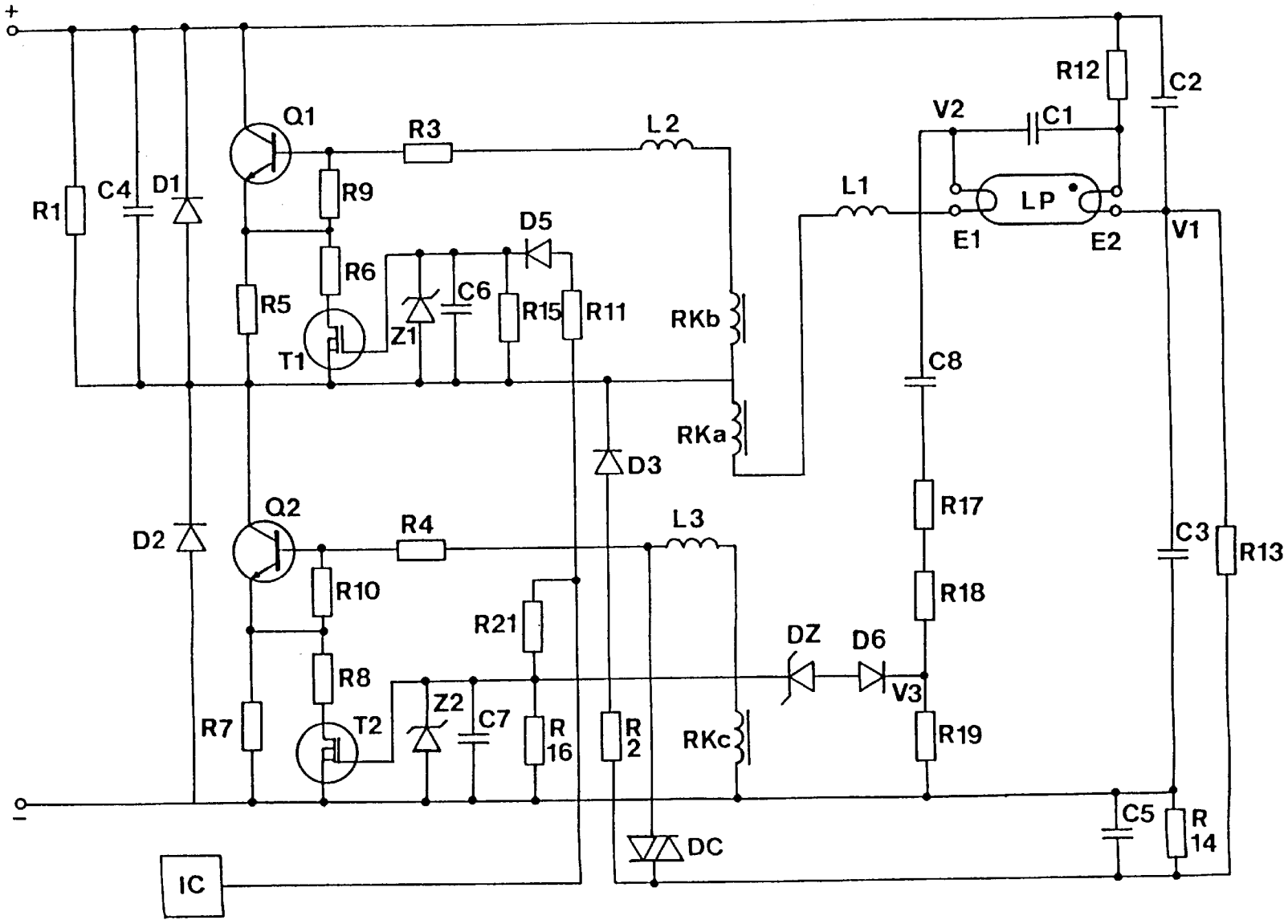
R13
C2
V1
C3
R 14
C5
R12
C1
E2
LP
E1
V2
C8
R17
R18
R19
V3
D6
DZ
L1
RKb
RKa
L3
RKc
DC
L2
D3
R 2
R11
D5
R15
R 16
R21
C7
C6
Z2
Z1
R3
R4
R9
R6
R10
R8
T2
T1
Q1
R5
Q2
R7
IC
D1
D2
C4
R1
+
-

CIRCUIT ARRANGEMENT FOR OPERATING ELECTRIC LAMP

BACKGROUND OF THE INVENTION

The invention relates to a circuit arrangement for operating electric lamps. A circuit arrangement of this type is, for example, disclosed in European Patent EP 0 093 469. This document describes an inverter, in particular a free-running half-bridge inverter with two alternately switching inverter transistors, in whose control circuit a time-switch device is in each case arranged. These time-switch devices essentially each consist of an auxiliary transistor and an RC element whose resistor is bridged by a Zener diode and whose capacitor is connected in parallel with the base-emitter path or the auxiliary transistor. Because of the Zener diodes, the time-switch devices have voltage-dependent time constants which make it possible to control the frequency and the duty factor of the half-bridge inverter and to set defined heating and striking conditions for the low-pressure discharge lamps. However, a disadvantage in this case is the large tolerance dependence of the electrode preheating, striking and operating parameters on the electronic components used. During the electrode preheating phase, an asymmetric control of the half-bridge inverter is employed. Because of this, with the same dimensioning of the load-circuit components and with the same voltage across the lamps, a circuit arrangement according to EP 0 093 469 delivers a smaller heating current during the electrode preheating phase than a comparable circuit arrangement with symmetrical drive of the half-bridge inverter. This disadvantage of the circuit arrangement according to the circuit arrangement described in the abovementioned patent occurs, in particular, in the case of so-called T2 and T5 fluorescent lamps which have comparatively sensitive electrodes. In order to ensure sufficient preheating of the electrode coils with the circuit arrangement corresponding to EP 0 093 469, even for the abovementioned lamp types, a resonant capacitor with a comparatively high capacitance would have to be used. However, this measure would lead to greater loading of all the components of the circuit arrangement during normal operation of the lamps. In particular, the so-called pin current, that is to say the continuous heating current flowing through the lamp electrode coils, which is composed-of the sum of the current through the resonant capacitor arranged in parallel with the lamp and the current flowing via the discharge path of the lamp, would increase in such a way that there would be a risk of premature lamp failure due to excessive thermal loading of the electrode coils.

SUMMARY OF THE INVENTION

The object of the invention is to provide a circuit arrangement for operating electric lamps, having a free-running half-bridge inverter and with improved driving of the inverter transistors, matched to the various operating phases of the lamps. In particular, the intention is for the circuit arrangement according to the invention, when operating the abovementioned fluorescent lamps, on the one hand to ensure satisfactory preheating of the lamp electrodes and, on the other hand, to avoid an excessive increase in the pin current.

The circuit arrangement according to the invention has a free-running half-bridge inverter, to the output of which a load circuit is connected, this load circuit being designed as a resonant circuit and having at least one electric lamp arranged in it. The two inverter transistors have a control circuit into which an auxiliary transistor is in each case connected. According to the invention, these auxiliary transistors are connected into the control circuits of the inverter transistors in such a way that the emitter or source impedance of these inverter transistors is formed by a parallel circuit which consists of at least one resistor and the output path, connected in parallel therewith, of the corresponding auxiliary transistor. Furthermore, the control inputs of the two auxiliary transistors are, according to the invention, connected to the output of a common control circuit. These measures make it possible to switch over the effective emitter impedance or source impedance of the half-bridge inverter transistors and therefore the feedback for the half-bridge inverter transistors, as a function of the various operating phases (that is to say, for low-pressure discharge lamps: preheating of the lamp electrodes, striking of the lamp, normal operation of the lamp). This switch-over of the feedback for the half-bridge inverter transistors varies the duty factor and/or the clock frequency of the half-bridge inverter. The frequency detuning which can be achieved thereby between the resonant frequency of the load circuit and the clock frequency of the half-bridge inverter allows optimum matching of the electrical parameters of the load circuit for each of the three abovementioned operating phases. The feedback of the half-bridge inverter transistors can be influenced within wide limits by suitable dimensioning of the resistances of the parallel circuits according to the invention, which form the emitter impedances or source impedances of the half-bridge inverter transistors.

The parallel circuits according to the invention, which form the emitter impedances of the half-bridge inverter transistors, advantageously have in each case at least one further resistor which is connected in series with each output path of the corresponding auxiliary transistor and is arranged in parallel with the at least one resistor of the relevant parallel circuit. The dimensioning of these resistors is advantageously selected in such a way that, for each of the parallel circuits according to the invention, which form the emitter impedance of a half-bridge inverter transistor, the total resistance of the resistors arranged in parallel with the output path of the auxiliary transistor is about one order of magnitude greater than the total resistance of the resistors connected in series with the auxiliary transistor. These measures ensure that the feedback of the half-bridge inverter can be varied within wide limits.

A capacitor, to which at least one discharge resistor is in turn connected in parallel in each case, is advantageously in each case arranged in parallel with the output paths of the auxiliary transistors. Furthermore, the output of the control circuit is in each case connected via at least one charging resistor to the control inputs of the auxiliary transistors. The resistances of these charging resistors are smaller than the resistances of the discharge resistors, so that the time constant for the discharging process of the capacitors connected in parallel with the auxiliary transistors is considerably greater than the time constant for the charging process of these capacitors. Furthermore, in the case of at least one auxiliary transistor, connection to the output of the control circuit advantageously takes place via at least one diode. These measures ensure reliable driving of the auxiliary transistors from a common control circuit.

The half-bridge inverter transistors are advantageously bipolar transistors, whereas the auxiliary transistors are advantageously field-effect transistors.

The preferred illustrative embodiment of the circuit arrangement according to the invention furthermore has a voltage divider which is connected via a tap in the load circuit to a resonant-circuit component and which monitors the voltage drop across this component. The control input of one of the auxiliary transistors is advantageously connected via a threshold-value element to this voltage divider. This voltage divider makes it possible to vary constantly the electrical conductivity of the drain-source path of the abovementioned auxiliary transistor as a function of the voltage drop across the resonant-circuit component connected to the voltage divider. The effective emitter impedance of the corresponding half-bridge inverter transistor therefore also varies constantly. The abovementioned voltage divider thus additionally provides the possibility of regulating the voltage drop across the resonant-circuit component continuously.

BRIEF DESCRIPTION OF THE DRAWINGS

The invention will be explained in more detail below with reference to a preferred illustrative embodiment.

The figure shows the circuit arrangement according to the preferred illustrative embodiment. This circuit arrangement is used for operating a T5 fluorescent lamp LP which has an electrical power consumption (rated power) of about 35 W. A suitable dimensioning of the electrical components of the preferred illustrative embodiment of the circuit arrangement according to the invention is specified in the table.

BEST MODE FOR CARRYING OUT THE INVENTION

This circuit arrangement has a free-running half-bridge inverter equipped with two npn bipolar transistors Q1, Q2. The half-bridge inverter is supplied with a DC voltage which is obtained in conventional fashion by rectification from the mains voltage. A load circuit designed as a resonant circuit is connected to the output M of the half-bridge inverter. It contains the primary winding RKa of a toroidal-core transformer, a resonant inductor L1, the electrode coil E1 of the lamp LP, a resonant capacitor C1 and the electrode coil E2 of the fluorescent lamp LP. The discharge path of the low-pressure discharge lamp LP is connected in parallel with the resonant capacitor C1. The resonant capacitor C1 is furthermore connected via the electrode coil E2 to the centre tap V1 between the two coupling capacitors C2, C3 which, for their part, are arranged in parallel with the half-bridge inverter Q1, Q2.

The half-bridge inverter is driven with the aid of the toroidal-core transformer, the primary winding RKa of which is a component of the load circuit, and the secondary windings RKb, RKc of which are in each case arranged in a control circuit of the half-bridge inverter transistors Q1, Q2. In order to ensure start-up of the half-bridge inverter, the circuit arrangement has a starting device which essentially consists of the starting capacitor C5, the diac DC, the diode D3 and the resistors R2, R12, R13, R14. The two bipolar transistors Q1, Q2 of the half-bridge inverter are in each case equipped with a freewheeling diode D1, D2, which are connected in parallel with the collector-emitter path of the corresponding transistor Q1, Q2. A resistor R1 and a capacitor C4 are arranged in parallel with the freewheeling diode D1. In so far as this, the circuit arrangement corresponds to a free-running half-bridge inverter as, for example, disclosed on pages 62–63 of the book "Schaltnetzteile" (switched-mode power supplies) by W. Hirschmann/A. Hauenstein, published by Siemens AG.

The control circuits of the two bipolar transistors Q1, Q2 in each case contain a base series resistor R3 or R4 which is connected via an inductor L2 or L3 to the secondary winding RKb or RKc, arranged in this control circuit, of the toroidal-core transformer. The emitter impedance of the bipolar transistor Q1 is formed by a parallel circuit consisting of the resistors R5, R6 and the auxiliary transistor T1. This parallel circuit is configured in such a way that the lower-value resistor R6 is arranged in series with the drain-source path of the auxiliary transistor T1 and the higher-value resistor R5 is connected in parallel with this series circuit consisting of the resistor R6 and the drain-source path of the auxiliary transistor T1. Similarly, the emitter impedance of the bipolar transistor Q2 is formed by a parallel circuit consisting of the resistors R7, R8 and the auxiliary transistor T2. This parallel circuit is likewise configured in such a way that the lower-value resistor R8 is arranged in series with the drain-source path of the auxiliary transistor T2 and the higher-value resistor R7 is connected in parallel with this series circuit consisting of the resistor R8 and the drain-source path of the auxiliary transistor T2. The control circuits of the two half-bridge inverter transistors Q1, Q2 furthermore in each case have a base-emitter parallel resistor R9 or R10, which is connected in parallel with the base-emitter path of the corresponding bipolar transistor Q1, Q2 and which improves the switching performance of these two bipolar transistors Q1, Q2.

The two auxiliary transistors T1, T2 are field-effect transistors which are driven with the aid of the control circuit IC. To this end, the output of the control circuit IC is connected, on the one hand, via the resistor R11 and the diode D5 to the gate electrode of the field-effect transistor T1 and, on the other hand, via the resistor R21 to the gate electrode of the field-effect transistor T2. A capacitor C6 or C7 and a resistor R15 or R16 are in each case connected in parallel with the gate of the field-affect transistor T1 or T2. Furthermore, a Zener diode Z1, Z2, used as overvoltage protection, is in each case arranged in parallel with the gate of each auxiliary transistor T1, T2.

The circuit arrangement furthermore has a voltage divider which essentially consists of the resistors R17, R18 and R19. This voltage divider is connected via the capacitor C8 and the branch point V2 to one electrode of the resonant capacitor C1 and to one terminal of the lamp electrode E1, so that the voltage divider is AC connected in parallel with the resonant capacitor C1. The centre tap V3 between the resistors R18, R19 of the voltage divider is connected via a diode D6 and a Zener diode DZ to the gate electrode of the field-effect transistor T2. The Zener diode DZ and the diode D6 are biased in opposite directions.

After the circuit arrangement has been switched on, the starting capacitor C5 is charged via the resistors R12, R13 to the breakdown voltage of the diac DC which then produces trigger pulses for the base of the bipolar transistor Q2 and thereby causes the half-bridge inverter to start up. After the transistor Q2 has been switched on, the starting capacitor C5 is discharged via the resistor R2 and the diode D3 until the diac DC no longer generates trigger pulses. The two inverter transistors Q1, Q2 switch alternately, so that the centre tap M of the half-bridge is alternately connected to the plus or minus pole of the DC voltage supply. As a result, a medium-frequency alternating current, the frequency of which coincides with the clock frequency of the half-bridge inverter, is produced between the taps M and V1 in the load circuit designed as a series resonant circuit. The clock frequency of the half-bridge inverter is usually more than 20 kHz. The electronic components of the circuit arrangement according to the invention are furthermore dimensioned in such a way that the clock frequency of the free-running half-bridge inverter is above the resonant frequency of the series resonant circuit L1, C1. The auxiliary transistors T1, T2 are at first off, so that only the higher-value resistors R5 or R7 are active as an emitter impedance for the bipolar transistors Q1, Q2. These comparatively large emitter impedances R5, R7 cause relatively strong negative feedback of the half-bridge inverter. As a result, the toroidal-core transformer reaches its saturation magnetization within just a comparatively short time, so that the clock frequency of the half-bridge inverter is correspondingly high. The clock frequency of the half-bridge inverter is therefore at first so far above the resonant frequency of the resonant circuit L1, C1 that the voltage drop which builds up across the resonant capacitor C1 is not sufficient to strike the fluorescent lamp LP. During this electrode preheating phase, which takes place directly after start-up of the half-bridge inverter, a medium-frequency heating current, which heats the electrode coils E1, E2, flows through the electrode coils E1, E2 of the lamp LP and via the resonant capacitor C1. After the preheating period,. predetermined by the control circuit IC, has elapsed the control circuit IC switches over its output voltage from approximately 0 V to about 10 V to 12 V, so that the control voltage for switching on the field-effect transistor T2 is built up via the resistor R21 across the capacitor C7.

Similarly, while the transistor Q2 is switched on, that is to say while the centre tap M of the half-bridge inverter is at the earth potential, the control voltage for switching on the field-effect transistor T1 is built up via the resistor R11 and via the diode D5 across the capacitor C6. While the bipolar transistor Q2 is switched on, the capacitor C6 is charged by the control circuit IC via the charging resistor R11 and via the diode D5 to the control voltage required to switch on the auxiliary transistor T1. Since the discharge resistor R15 has a considerably greater resistance than the charging resistor R11, the time constant of the capacitor C6 for the discharging process is substantially greater than for the charging process, so that the control voltage required for switching-on for the auxiliary transistor T1 is still applied across the capacitor C6 even if the on period of the bipolar transistor Q2 has already finished. The capacitor C6 is recharged via the resistor R11 and the diode D5 in each on phase of the bipolar transistor Q2.

When the field-effect transistors T1 are on, the effective emitter impedance for the bipolar transistors Q1 is given by the total or equivalent resistance of the resistors R5 and R6 which are then connected in parallel, if the resistance of the drain-source path of the auxiliary transistor T1 is ignored. The same is similarly true for the effective emitter impedance of the bipolar transistor Q2 which, when the auxiliary transistor T2 is on, is essentially given by the equivalent resistance of the parallel resistors R7 and R8. Because of the effective emitter impedance of the bipolar transistors Q1, Q2, which is then considerably lower, and the resulting reduced feedback of the half-bridge inverter, the clock frequency of the half-bridge inverter decreases. The detuning between the clock frequency of the half-bridge inverter and the resonant frequency of the resonant circuit L1, C1 then decreases to the extent that the striking voltage required to strike the lamp LP is produced across the resonant capacitor C1 by the resonant amplification method. After the lamp LP has been struck, the then electrically conductive discharge path of the lamp LP represents a shunt to the resonant capacitor C1, so that the voltage drop across the resonant capacitors C1 is then only the operating voltage of the lamp LP.

Because of the sensitive electrodes E1, E2 of the lamp LP, the resonant-circuit components C1, L1 are, in the preferred illustrative embodiment, dimensioned in such a way that only a relatively small pin current flows through the electrodes E1, E2. The resonant circuit of the preferred illustrative embodiment therefore has a comparatively high-value resonant inductor L1 and a relatively high Q-factor. Because of the high Q-factor of the resonant circuit, a high voltage drop can build up across the resonant-circuit components C1, L1. The voltage divider R17, R18, R19 then, together with the Zener diode DZ and the diode D6, affords an additional possibility of limiting or regulating the voltage drop in the resonant circuit C1, L1.

At the tap V2 in the series resonant circuit, the voltage drop across the resonant capacitor C1 or across the lamp LP is detected by this voltage divider and divided down according to the resistances of the resistors R17, R18, R19. So long as the amplitude of the resonant-capacitor voltage is below a critical value which can be set to a desired value by suitable dimensioning of the voltage-divider resistors, the Zener diode DZ remains at zero current, as therefore does the current path which leads from the gate of the field-effect transistor T2 via the Zener diode DZ and the resistor R19 to the minus pole of the DC voltage source, and the field-effect transistor T2 keeps its full control signal. If the amplitude of the resonant-capacitor voltage reaches this critical value then, when the negative half-cycle of the resonant-capacitor voltage takes place, the voltage drop between the gate of the field-effect transistor T2 and the branch point V3 increases to such an extent that the Zener diode DZ is turned on. This has the result that the gate of the field-effect transistor T2 then receives only a reduced control signal, since a part of the control signal arriving from the control circuit IC is drained to the minus pole of the DC voltage source via the Zener diode DZ which is then on and the voltage-divider resistor R19. The rectifier diode D6 is biased in such a way that the Zener diode DZ only reacts sensitively to the negative half-cycle of the resonant-capacitor voltage. A reduced control signal for the gate of the field-effect transistor T2 decreases the conductivity of the drain-source path of the field-effect transistor T2 and thus increases the effective emitter impedance of the bipolar transistor Q2. The effective emitter impedance of the bipolar transistor Q2 is in this case calculated from the no longer negligible resistance of the drain-source path of the auxiliary transistor T2 and the resistances of the resistors R7 and R8. This increase in the effective emitter impedance of the transistor Q2 causes a shortened on time of the bipolar transistor Q2 and correspondingly increases the clock frequency of the half-bridge inverter, as a result of which the no-load voltage across the resonant-capacitor is reduced.

The invention is not restricted to the illustrative embodiment explained in detail above. For example, the circuit arrangement according to the invention can also be used for dimming the lamp LP. To this end, the control circuit IC should be designed in such a way that, for driving the auxiliary transistors T1, T2, does not merely switch over between two voltage levels 0 V and 12 V, as described above with reference to the illustrative embodiment, but furthermore provides a continuously variable output voltage after the lamp has been struck.

TABLE

Dimensioning of the electrical components of the circuit arrangement according to the preferred illustrative embodiment

| | |
|---|---|
| R1 | 3.3 MΩ |
| R2, R11 | 22 kΩ |
| R3, R4 | 8.2 Ω |

TABLE-continued

| Dimensioning of the electrical components of the circuit arrangement according to the preferred illustrative embodiment | |
|---|---|
| R5 | 18 Ω |
| R6, R8 | 1 Ω |
| R7 | 15 Ω |
| R9, R10 | 47 Ω |
| R12, R13 | 560 kΩ |
| R14 | 1 MΩ |
| R15 | 220 kΩ |
| R16 | 470 kΩ |
| R17, R18 | 330 kΩ |
| R19 | 56 kΩ |
| R21 | 47 kΩ |
| C1 | 3.3 nF |
| C2, C3 | 200 nF |
| C4 | 1.5 nF |
| C5, C6, C7 | 100 nF |
| C8 | 100 pF |
| L1 | 4 mH |
| L2, L3 | 10 μH |
| D1, D2, D3, D5 | 1N4946GP |
| D6 | 1N414B |
| Z1, Z2 | Zener diode, 12 V |
| DZ | Zener diode, 39 V |
| DC | diac |
| Q1, Q2 | BUF 620 |
| T1, T2 | STK14N05 |
| IC | timer, IC 40106 |
| RKa, RKb, RKc | toroidal core R8/4/3.8 |

What is claimed is:

1. Circuit arrangement for operating electric lamps, the circuit arrangement having the following features:

a free-running half-bridge inverter with first and second alternately switching inverter transistors (Q1, Q2), each of the inverter transistors having an emitter or source terminal, a first auxiliary transistor (T1) which is connected into the control circuit of the first half-bridge inverter transistor (Q1), a second auxiliary transistor (T2) which is connected into the control circuit of the second half-bridge inverter transistor (Q2), a load circuit which is connected to the output (M) of the inverter, is designed as a resonant circuit and into which at least one electric lamp (LP) is connected, characterized in that an impedance connected to the emitter or source terminal of the first half-bridge inverter transistor (Q1) is formed by a parallel circuit (R5, T1) which consists of at least one resistor (R5) and an output path, arranged in parallel therewith, of the first auxiliary transistor (T1), an impedance connected to the emitter or source terminal of the second half-bridge inverter transistor (Q2) is formed by a parallel circuit (R7, T2) which consists of at least one resistor (R7) and an output path, arranged in parallel therewith, of the second auxiliary transistor (T2), the control inputs of the two auxiliary transistors (T1, T2) are connected to the output of a common control circuit (IC).

2. Circuit arrangement according to claim 1, characterized in that a capacitor (C6, C7) is in each case arranged in parallel with an output paths of the auxiliary transistors (T1, T2).

3. Circuit arrangement according to claim 2, characterized in that at least one discharge resistor (R15, R16) is in each case connected in parallel with the capacitors (C6, C7).

4. Circuit arrangement according to claim 1, characterized in that, in the case of at least one auxiliary transistor (T1), connection to the output of the control circuit (IC) takes place via at least one diode (D5).

5. Circuit arrangement according to claim 3, characterized in that the output of the control circuit (IC) is in each case connected via at least one charging resistor (R11, R21) to the control inputs of the auxiliary transistors (T1, T2), the resistances of these charging resistors (R11, R21) being smaller than the resistances of the discharge resistors (R15, R16).

6. Circuit arrangement according to claim 1, characterized in that the auxiliary transistors (T1, T2) are field-effect transistors.

7. Circuit arrangement according to claim 1, characterized in that the two parallel circuits (R5, T1; R7; T2) in each case have at least one further resistor (R6; R8) which is connected in series with the control path of the corresponding auxiliary transistor (T1; T2) and in parallel with the at least one resistor (R5; R7) of the relevant parallel circuit (R5, T1; R7; T2).

8. Circuit arrangement according to claim 1, characterized in that the control input at least of one auxiliary transistor (T2) is connected to a voltage divider (R17, R18, R19) which is connected, via a branch point (V2) in the load circuit, to a resonant circuit component (C1).

9. Circuit arrangement according to claim 8, characterized in that the control input of the at least one auxiliary transistor (T2) is connected, via a threshold-value element (DZ), to the voltage divider (R17, R18, R19).

10. Circuit arrangement according to claim 1, characterized in that, during normal operation of the lamp (LP), the control circuit (IC) produces a continuously variable output voltage.

* * * * *